United States Patent [19]

Hughen et al.

[11] 4,268,827

[45] May 19, 1981

[54] OPERABILITY VERIFICATION FOR SEGMENTAL ELECTROMAGNETIC DISPLAY

[75] Inventors: James F. Hughen, Austin; Jimmy R. Herring, Round Rock; David A. Biedermann, Austin, all of Tex.; Christopher W. Ovens, Boulder, Colo.

[73] Assignee: Dresser Industries, Inc., Dallas, Tex.

[21] Appl. No.: 77,691

[22] Filed: Sep. 21, 1979

[51] Int. Cl.[3] ..... G09F 9/32

[52] U.S. Cl. ..... 340/715; 340/643; 340/713

[58] Field of Search ..... 340/715, 713, 714, 786, 340/664, 653, 641, 642, 643, 635

[56] References Cited

U.S. PATENT DOCUMENTS

| | | | |
|---|---|---|---|
| 3,548,403 | 12/1970 | Johnson | 340/715 |
| 3,696,390 | 10/1972 | Cohen | 340/715 |
| 3,725,898 | 4/1973 | Canton | 340/786 |
| 3,829,653 | 8/1974 | Ensminger et al. | 340/713 |
| 3,866,171 | 2/1975 | Loshbough | 340/715 |
| 3,877,008 | 4/1975 | Payne | 340/786 |

*Primary Examiner*—Marshall M. Curtis
*Attorney, Agent, or Firm*—Daniel Rubin

[57] ABSTRACT

In fuel dispensing apparatus utilizing seven-segment electromagnetic displays each segment of all the displays is operatively driven and tested seriatum both prior to and during the dispensing cycle by measuring the current flowing therethrough. Where peak current through each segment coil exceeds a predetermined switching value within an allotted time period, an inactivating signal is emitted via a microprocessor to inactivate the drive for the respective segment. Failure to receive one or more of the inactivating drive signals per display represents a display malfunction which via the microprocessor renders the dispensing apparatus inoperable.

14 Claims, 2 Drawing Figures

SEGMENT DRIVE
RESET DRIVE
MICROPROCESSOR
DIGIT I
RESET
g
8 OFF
RESET
TO OTHER DIGITS
+50V
+5V
50V D.C. AT 0.2A MAX.
C-1
R1
R2
T1
T2
T3
T4
T8
T9
T10
T11
T12
T14
D1
D2
D3
D4
D5
D6
D7
D9
D11
D13
D15
D16
D17
a
b
c
d
e
f
g
18
20
22
24
26
28
30
32
34
36
38
40
41
42
44
46
47
48
49
50
51
52
53
54
55

OPERABILITY VERIFICATION FOR SEGMENTAL ELECTROMAGNETIC DISPLAY

TECHNICAL FIELD

The field of art to which the invention relates includes the art of electromagnetic display characters and more specifically to circuitry for operability verification of such displays.

BACKGROUND OF THE INVENTION

The seven-segment numeric display unit, as disclosed for example in U.S. Pat. No. 3,943,500, has become increasingly popular in recent years. Such units employ a seven bar readout which in any one of ten combinations can simulate numbers 1 through 9 or 0. They are commonly used with electronics in providing an ongoing display of numerical data in response to a changing electronic information input. A commercial form of these units is available from Ferranti-Packard, Ltd. of Toronto, Ontario, Canada, in which the individual bar or segment is rotatably supported at a housing window. Each bar has a non-display side finished to blend or match with the viewing face of the housing while the opposite side is finished in a light reflective material to contrast with and render it visually distinctive from the viewing face of the housing. An electromagnetic coil operatively associated with each segment will, when energized, rotate the segment between the non-display and display positions. A typical application for such displays is on electronically controlled gasoline dispensers for providing volume, price and unit price information transacted with the dispenser.

While the seven-segment display has proven itself over extended periods of use, they are susceptible to partial failures by inoperation of one or more of the individual segments. Since any segment failure results in an inaccurate display of the information sought to be provided, it has become increasingly common to employ a feedback detection circuit for identifying display inaccuracies as disclosed, for example, in mentioned U.S. Pat. No. 3,943,500. One approach to failure detection has been to utilize individual current sensors in series with the solid state drivers that operate each of the segments in order to measure the current level achieved by the sensors. While believed to function accurately, the multiplicity of the individual sensor approach has required both an excessive power supply and excessively large solid state switch devices for switching the encountered current levels. These factors have therefore rendered that approach somewhat objectionable, but despite recognition of the problem a ready solution has not heretofore been known.

BRIEF SUMMARY OF THE INVENTION

The invention relates to electromagnetic light reflective displays and to operability verification logic therefor. More specifically, the invention relates to failure detection circuitry that reliably limits the power consumed by the displays to the minimum required for operation. By not utilizing the individual sensor technique of the prior art, the excessive power supplies and the larger than necessary solid state switching devices associated therewith have been eliminated.

The foregoing is achieved in accordance with the invention by verifying segment operability prior to and during each operating cycle. The segments are operated seriatum by a microprocessor to determine whether the peak current of each exceeds a switching value within a controlled time drive period. If the peak current through the activated segment coil exceeds the segment switching value within the allotted time period, a comparator signals the microprocessor to inactivate the drive. Should one or more of the inactivating drive signals not be emitted from the comparator, the display is identified as malfunctioning. Since the current pulses are drawn from a capacitor being recharged from the power supply at a limited current while the on/off ratio of the drive is small, the main current drawn from the power supply is minimal. By these means therefore the prior mentioned problems of excessively large power supplies and switching devices for verifying display operability in the manner of the prior art is thereby eliminated as to achieve verification in a much more economical and efficient manner.

It is therefore an object of the invention to provide a novel feedback detection system for verifying operability of a seven-segment display.

It is a further object of the invention to effect the previous object with substantially reduced instantaneous power requirements as compared to similar purpose detector systems of the prior art.

BRIEF DESCRIPTION OF THE DRAWINGS

Referring to FIG. 1, there is illustrated a gasoline dispenser 10 as typically utilized at a gasoline service station site. Both the monetary display 12 utilizing the seven-segment numerical digits 18, 20 and 22 and the volume display 14 utilizing numerical digits 24, 26 and 28 are of the aforementioned type manufactured by Ferranti-Packard of Toronto, Ontario, Canada. Additional displays 13 of the same type for unit price information may be utilized where desired. For each transaction in which gasoline is dispensed from pump 10, operation of displays 12 and 14 is effected by a control unit (not shown) in pump 10. An electronic central control 16 is typically located in a kiosk on the site remote from dispenser 10 for receiving point of sale information and to initiate dispenser reset.

Figure 1:
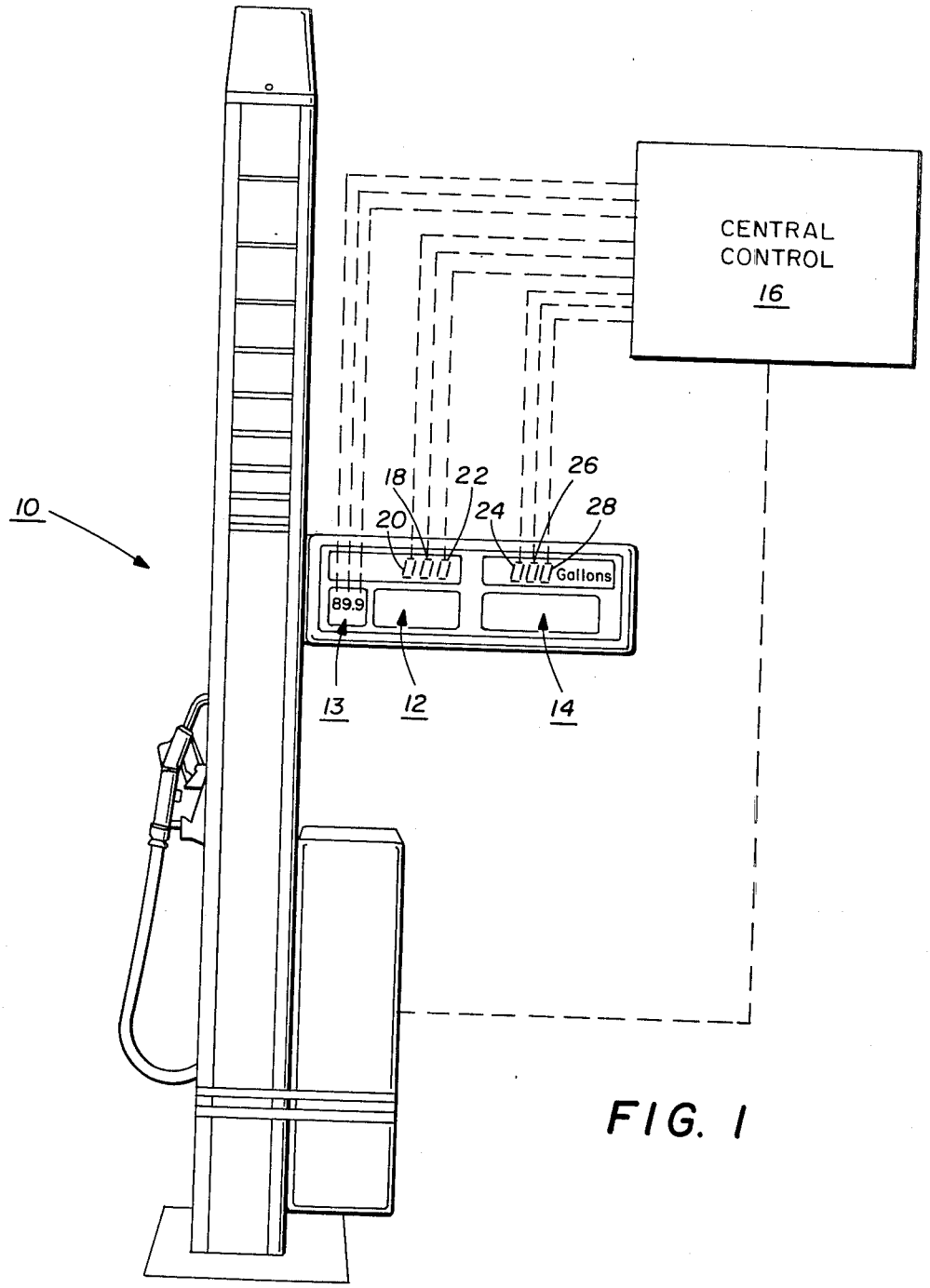
FIG. 1 is an elevation view of a gasoline fuel dispenser utilizing a seven-segment display incorporating the display verification system hereof.
Figure 2:
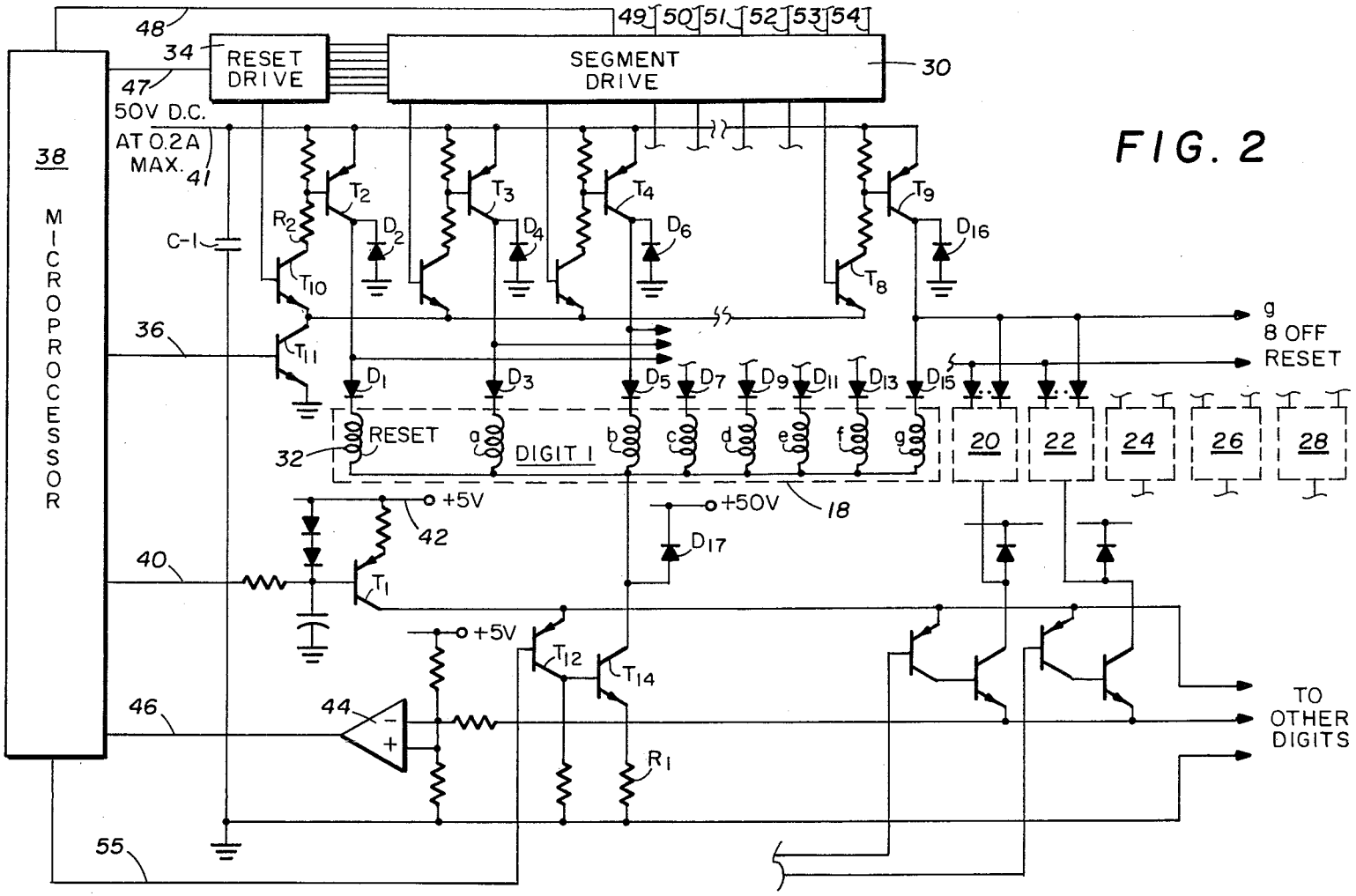
FIG. 2 is a schematic circuit diagram for the verification system hereof.

For an understanding of the digit verification in accordance with the invention, reference is made to FIG. 2 in which each of the digits is identified by a phantom block. Only digit 18 is shown in detail for purposes of explanation, it being understood that the other digits are similarly operable.

Digit 18 as illustrated is comprised of seven-segment coils designated "a" through "g" each driven selectively by a segment drive 30 and a parallel reset coil 32 driven by reset drive 34. Typically, each segment coil includes a two winding pole piece, one of which is connected in series with the others of the display unit to form the reset coil and the other of which comprises the set winding. Also included with the segment coils are diodes $D_1$, $D_3$, $D_5$, $D_7$, $D_9$, $D_{11}$, $D_{13}$, and $D_{15}$ which serve to isolate each drive signal from the drive signals of the other digits as will be understood. Insofar as digit 18 may be duplicated on the opposite side of pump 10, a double sided display for purposes hereof is regarded as two different displays with the side being verified at any point in time being under the control of segment group select line 36 actuated by microprocessor 38.

Once microprocessor 38 is powered up, digit drive enable line 40 is held low which serves to turn on transistor $T_1$. This forms a 25 milliamp current source from the 5 volt supply line 42 for the transistor bases of digit drive transistors $T_{14}$ through $T_{xx}$, inclusive to be appropriately turned on by the microprocessor. With segment group select line 36 high, transistor $T_{11}$ is turned on providing a ground return for the collector currents of the segment drive transistors $T_2$ through $T_9$. As no current is yet flowing through the segment coils "a" through "g" or reset coil 32, resistor $R_1$, connecting the inverting input of comparator 44, is at ground potential. This serves to hold the non-inverting input to the comparator at below +2 volts rendering the comparator output line 46 high while 82 mfd capacitor $C_1$ is being fully charged by 50 volt, 0.2 amp supply line 41.

Reset drive line 47 to control reset coil 32 is then pulled high by microprocessor 38 while lines 48 through 54 connecting to segment drives 30 are held low by the microprocessor. With reset drive line 47 going high, transistor $T_{10}$ is turned on, concomitantly turning on transistor $T_2$ via resistor $R_2$. With digit drive line 55 simultaneously going low, transistor $T_{12}$ is turned on delivering the 25 milliamp current from transistor $T_1$ to the base of transistor $T_{14}$ for turning on the latter.

After the foregoing has occurred, a conducting path from 50 volt supply line 41 is established via transistor $T_2$, diode $D_1$, reset coil 32, transistor $T_{14}$ and resistor $R_1$ to ground. Since this path contains the inductance and resistance of coil 32, the current rises at a rate determined by the applied voltage and the inductance and resistance values of the coil. When this current has risen to 4 amps in the magnetic reset coils of segments "a" through "g" of digit 18, the digit will have reset, at which time the voltage across $R_1$ will have risen to 2 volts. As the voltage passes this value, comparator 44 switches causing its output detection line 46 to go low. When received by microprocessor 38 within a time period to be described, the low level of line 46 constitutes a switching signal for the processor to remove the drive signal on line 47 to drive 34. Since removal of the drive signal is not accomplished instantly, the current continues to increase. However, since the base of transistor $T_{14}$ is only driven from 5 volt supply 42, the emitter of $T_{14}$ rises with increasing voltage across $R_1$. At a current of approximately 5 amps, the base drive to $T_{14}$ is therefore reduced to such an extent that $T_{14}$ acts to limit the current until the drive of reset drive 34 is turned off by microprocessor 38.

On expiration of a fixed time period following reset, segment drive lines 48 through 54 are sequentially energized. The one energized drive is held high while reset drive line 47 and the other segment drive lines are held low. This establishes a conducting path from 50 volt supply line 41 via the affected transistor $T_3$ through $T_9$ its respective diode, transistor $T_{14}$ and resistor $R_1$ to ground. Since this path contains inductance and resistance of the energized coil, the current rises at a rate determined by the applied voltage and the coil values of inductance and resistance. When the current value rises to 4 amps in the affected segment coil, that segment is activated while the voltage signal across resistor $R_1$ causes comparator 44 to switch its output detection line 46 to a low signal. When received by microprocessor 38 within the prescribed time period, the low signal of line 46 constitutes a switching signal for the processor to remove the drive signal on the affected line to drive 30.

Since the 50 volt power supply on line 41 can only deliver 0.2 amps, the high current pulses are drawn from capacitor $C_1$. After any one of the drives is turned off, $C_1$ is recharged to 50 volts at a constant current of 0.2 amps. Diodes $D_2$, $D_4$, $D_6$, $D_8$, $D_{10}$, $D_{12}$, $D_{14}$, and $D_{16}$, clamp the voltage spikes generated by switching off the inductor load to within the limits of the supply voltages. All diodes are utilized to protect solid state switches. To allow for the complete recharging of $C_1$, the minimum time between segment drive pulses is controlled to one or two milliseconds and after reset about twice this time is allowed.

Signal 46 is supplied via a clock (not shown) in microprocessor 38. Failure to receive the detect current signal on line 46 within 50 microseconds for any of the segment drive signals and 300 microseconds for the reset drive signal inactivates drives 30 and/or 34, respectively. Greater time is allowed for the reset signal in view of the higher inductance and consequent slower rate of current rise in coil 32. Failure to receive the verification signal before expiration of the mentioned time periods likewise causes the microprocessor to render dispenser 10 inoperable.

In operation, verification of displays 12 and 14 is first undertaken when initiating a transaction with dispenser 10 and then subsequently in the course of dispensing. Reset drive 34 when activated operates to actuate reset coils 32 which in turn activates all the coils "a" through "g" to the reset relation for displays 12 and 14 to show the figure 8. Segment signals are then sent seriatum via segment drive 30 to blank the unwanted segments. The sequence is repeated for each digit that requires updating on each of the displays. Should any signal 46 fail to reach its switching value within the allotted time period, a malfunction is indicated, and processor 38 operates to inactivate the drives 34 and/or 30 and immediately render pump 10 inoperable. If no malfunction has been indicated, the displays will be operated in a well known manner in accordance with data signals received from pump 10 on the basis of a transaction being consummated.

By the above description there is disclosed novel logic for verifying operability of a seven-segment display in which each segment of each digit in a multiplexing scheme is signalled out. The current for each segment is measured and switched off when the switching level occurs within a predetermined time period. Since only a single current sensor is utilized, the current through the element substantially minimizes the required size of power supply and the solid state controlling devices utilized therewith as compared to similar purpose constructions of the prior art.

Since many changes could be made in the above construction and many apparently widely different embodiments of this invention could be made without departing from the scope thereof, it is intended that all matter contained in the drawings and specification shall be interpreted as illustrative and not in a limiting sense.

The embodiment of the invention in which an exclusive property or privilege is claimed are defined as follows:

1. In a multi-segment numeric display unit comprising a plurality of individual segments controllably operable for collective segments to visually form selected numeric values, each of said segments including a magnetic latch coil for individual operation of its associated segment, segment drive means for selectively energizing said latch coils and a reset coil operable when activated to energize a plurality of the latch coils of said individual segments for effecting a visual display of predetermined numeric value, verification means for verifying operability of the display unit comprising measuring means operable to measure the current flow seriatum through the coil of each of the segments, and logic means operable to inactivate the segment drive means to the energized coil when the current value through the energized coil achieves a predetermined switching value within a maximum time period.

2. In a numeric display unit according to claim 1 in which said logic means is also operable in response to a failure of current in the energized coil to achieve the predetermined switching value within the maximum time period to emit a deenergizing control signal.

3. In a numeric display unit according to claim 2 including reset drive means for energizing said reset coil and means to activate said reset drive means in a programmed sequence preceding said segment drive means being activated.

4. In a numeric display unit according to claim 3 in which said logic means includes a comparator receiving the measured current signals from the energized coils and appropriately responsive to timely received switching values of current during said programmed sequence to signal for operable removal of said reset drive means and for inactivation of said segment drive means.

5. In a numeric display unit according to claim 4 in which said logic means also includes a microprocessor for receiving the output signals from said comparator and responsive thereto for controllably operating both said reset drive means and said segment drive means.

6. In a numeric display unit according to claims 1, 2, 3, 4 or 5 in which the current pulses for said latch coils are supplied from a capacitor subject to recharge at a substantially constant controlled value of current.

7. In a numeric display unit according to claim 6 in which said display unit comprises a seven-segment display.

8. In a gasoline dispenser including a plurality of numeric display units operable for indicating dispensing data being incurred by said dispenser, each of said numeric display units comprising a plurality of individual segments controllably operable for collective segments to visually form selected numeric values with each of said segments including a magnetic latch coil for individual operation of its associated segment, segment drive means for selectively energizing said latch coils, and a reset coil operable when activated to energize a plurality of the latch coils of said individual segments for effecting a visual display of predetermined numeric value, verification means for verifying operability of the display unit comprising measuring means operable to measure the current flow seriatum through the coil of each of the segments, and logic means operable to inactivate the segment drive means to the energized coil when the current value through the energized coil achieves a predetermined switching value within a maximum time period.

9. In a gasoline dispenser according to claim 8 in which said logic means is also operable in response to a failure of current in the energized coil to achieve the predetermined switching value within the maximum time period to emit a deenergizing control signal for inactivating said dispenser.

10. In a gasoline dispenser according to claim 9 including reset drive means for energizing said reset coil and means to activate said reset drive means in a programmed sequence preceding said segment drive means being activated.

11. In a gasoline dispenser according to claim 10 in which said logic means includes a comparator receiving the measured current signals from the energized coils and appropriately responsive to timely received switching values of current during said programmed sequence to signal for operable removal of said reset drive means and for inactivation of said segment drive means.

12. In a gasoline dispenser unit according to claim 11 in which said logic means also includes a microprocessor for receiving the output signals from said comparator and responsive thereto for controllably operating both said reset drive means and said segment drive means.

13. In a gasoline dispenser unit according to claims 8, 9, 10, 11 or 12 in which the current pulses for said latch coils are supplied from a capacitor subject to recharge at a substantially constant controlled value of current.

14. In a gasoline dispenser according to claim 13 in which said display units comprise seven segment displays.

* * * * *

UNITED STATES PATENT AND TRADEMARK OFFICE

CERTIFICATE OF CORRECTION

PATENT NO. : 4,268,827

DATED : May 19, 1981

INVENTOR(S) : James F. Hughen et al.

It is certified that error appears in the above—identified patent and that said Letters Patent is hereby corrected as shown below:

Figure 2 should read as shown on the attached sheet.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,268,827

DATED : May 19, 1981

INVENTOR(S) : James F. Hughen, Jimmy R. Herring, David A. Biedermann and Christopher W. Ovens It is certified that error appears in the above-identified patent and that said Letters Patent are hereby corrected as shown below:

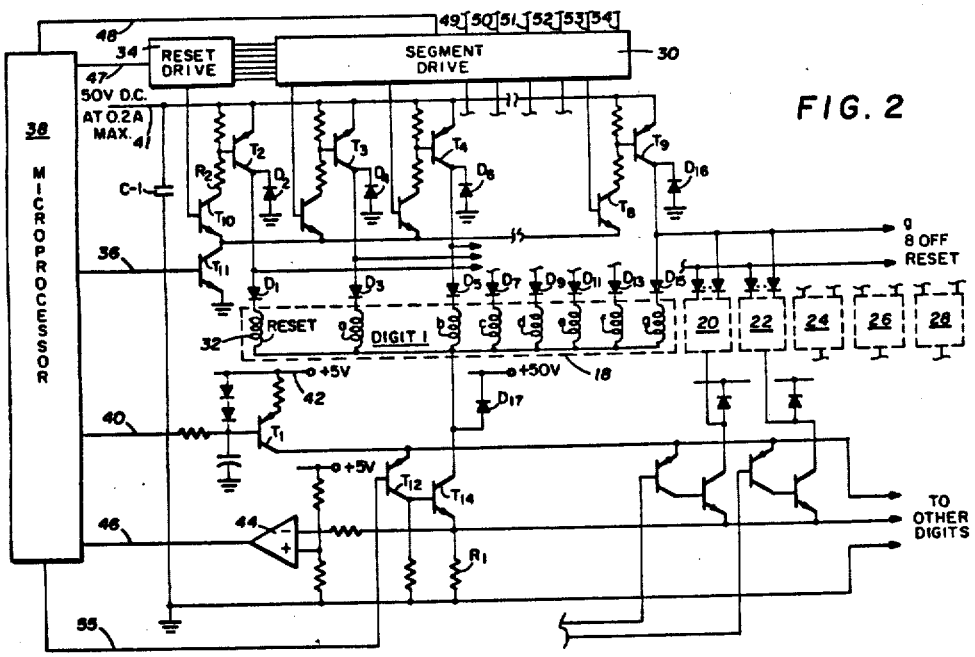

FIG. 2